US007003836B2

(12) United States Patent
Berg

(10) Patent No.: US 7,003,836 B2
(45) Date of Patent: Feb. 28, 2006

(54) PORTABLE CAR RAMP

(75) Inventor: Joel J. Berg, Chicago, IL (US)

(73) Assignee: Cencor Plastics, Inc., Wheeling, IL (US)

( * ) Notice: Subject to any disclaimer, the term of this patent is extended or adjusted under 35 U.S.C. 154(b) by 0 days.

(21) Appl. No.: 10/739,782

(22) Filed: Dec. 19, 2003

(65) Prior Publication Data

US 2005/0132511 A1 Jun. 23, 2005

(51) Int. Cl.
*E02C 3/00* (2006.01)

(52) U.S. Cl. ..... 14/69.5; 254/88

(58) Field of Classification Search ..... 254/88, 254/50; 14/69.5

See application file for complete search history.

(56) References Cited

U.S. PATENT DOCUMENTS 1,650,536 A * 11/1927 Pierce ..... 254/88
1,871,129 A * 8/1932 Pierce ..... 254/88
2,272,334 A * 2/1942 St Laurent ..... 254/88
3,638,910 A * 2/1972 Nellis et al. ..... 254/88
3,915,430 A * 10/1975 Chromy et al. ..... 254/88
4,165,862 A * 8/1979 Bennett ..... 254/88
4,427,179 A * 1/1984 Price ..... 251/88
5,118,081 A * 6/1992 Edelman ..... 254/88
5,176,361 A * 1/1993 Ayala, III ..... 254/88
5,483,715 A * 1/1996 Fogarty et al. ..... 14/69.5
6,135,420 A * 10/2000 Johnston et al. ..... 254/88
6,672,968 B1 * 1/2004 Montolio ..... 472/89
6,718,588 B1 * 4/2004 Frederiksen ..... 14/69.5

* cited by examiner

*Primary Examiner*—Raymond W Addie
(74) *Attorney, Agent, or Firm*—Charles F. Lind

(57) ABSTRACT

This portable car ramp has two structural components coupled longitudinally together, while allowing limited relative vertical movement when each's bottom edge rest on a medium surface. The first component has an elevated wheel run while the second component has an inclined wheel run. When coupled together, the component wheel runs are longitudinally aligned, meeting at a corner, so that a vehicle wheel can roll up the inclined run, over the corner, and onto the elevated run, and vice-versa. Friction pads fixed to the second component bottom edge increase resistance against ramp sliding along the medium surface, particularly with the wheel supported on the inclined wheel run. The first component has no bottom edge friction pads so that car ramp sliding along the medium surface is possible, such as should the wheel be rolled against a stop on the elevated wheel run.

3 Claims, 3 Drawing Sheets

PORTABLE CAR RAMP

BACKGROUND OF THE INVENTION

Portable car ramps are used for increasing vertical clearance beneath a vehicle having its wheels otherwise supported on a flat horizontal garage floor, driveway, or like support medium, so that a worker can repair, or service the vehicle from the underside thereof.

A typical portable car ramp will have bottom structure that can be rested in a stable manner on the support medium, a generally level wheel run extended substantially parallel to but elevated above the support medium, and an inclined wheel run extended between one end of the elevated wheel run and the support medium. The vehicle wheel can be rolled up the inclined run to the elevated run, and along it until restrained by a stop adjacent the opposite run end.

Popular portable car ramps might be about a foot wide, three to six feet long, and provide vertical wheel lifts between possibly six and fifteen inches with the inclined runs pitched between possibly ten and twenty five degrees.

Both sides of the vehicle frame can be elevated if two like car ramps are used, where both front wheels or both rear wheels can then be simultaneously rolled up the respective ramps and onto the respective elevated runs. To stabilize any vehicle supported on the ramps, a vehicle wheel yet on the support medium can be blocked.

One problem associated with car ramp use is that when the wheel weight is on the inclined run, particularly when the wheel is being rolled up the inclined run, horizontal vector forces are generated against the ramp tending to slide it along the support medium in the direction away from the vehicle. When severe sliding tendency exists, ramp bracing by external devices might be necessary.

However, permitting some car ramp sliding along the support medium might be beneficial, to reduce the possibility of the rolling wheel hitting and rolling over a non-yielding end stop and rolling then off of the ramp.

A further drawback of many known car ramps is their bulky size and/or heavy weight, making it difficult to move them about during use and/or to store them.

SUMMARY OF THE INVENTION

An object of this invention is to provide a portable car ramp comprised of separate components, respectively having thereon the inclined and elevated wheel runs, with means to separably couple the components together so that the runs are longitudinally aligned and meet. This allows a vehicle wheel to be rolled between either respective component, which then carries most if not all of the wheel weight.

Yet another object of this invention is to provide a friction pad fixed to the underside of the inclined run component suited to rest on the support medium and resist sliding of the inclined run component along the support medium when wheel weight is on the inclined run. The pad further might be part of an elongated mat aligned with and extended away from the inclined run to have the vehicle wheel on the mat when first rolling up the inclined run, for further precluding the inclined run component from sliding along the support medium before and as the wheel rolls up the inclined run.

A further object of this invention is to provide the elevated wheel run component with no underside friction means that will engage the support medium, so that wheel weight transfer from the inclined run component to the elevated run component might allow ramp sliding along the support medium for reducing possible wheel override off of the elevated run.

BRIEF DESCRIPTION OF THE DRAWINGS

The above and other objects and advantages of this invention can be more fully understood and appreciated after reviewing the following specification, including as a part thereof the accompanying drawings wherein.

DETAILED DESCRIPTION OF THE INVENTION

Figure 1:
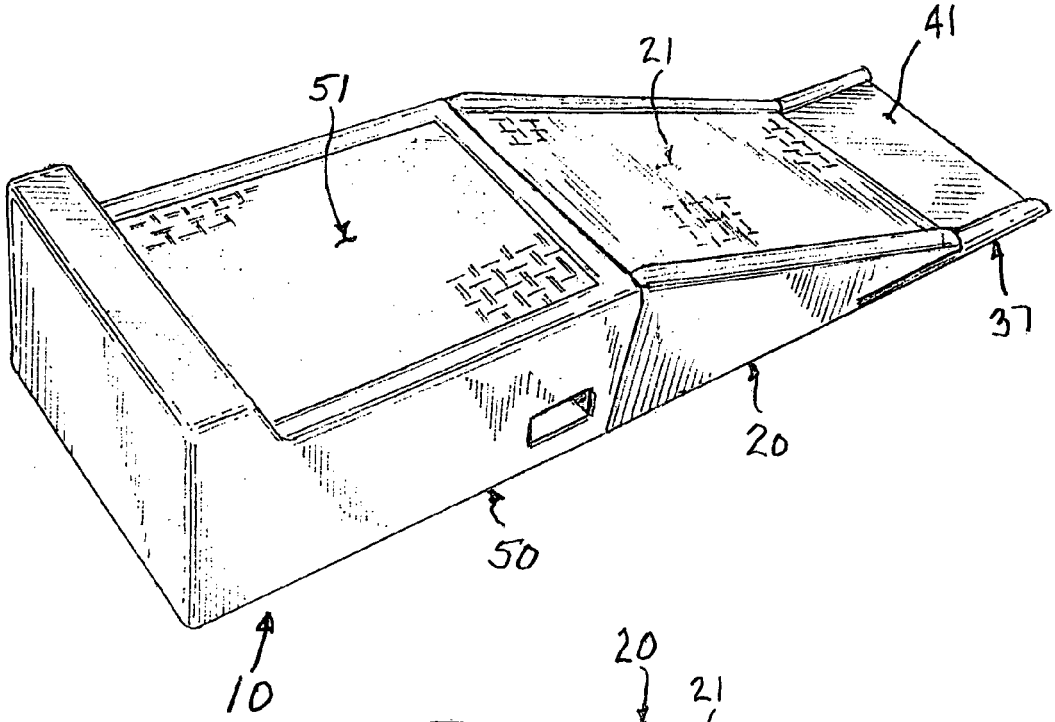
FIG. 1 is a perspective view of the improved car ramp.
Figure 2:
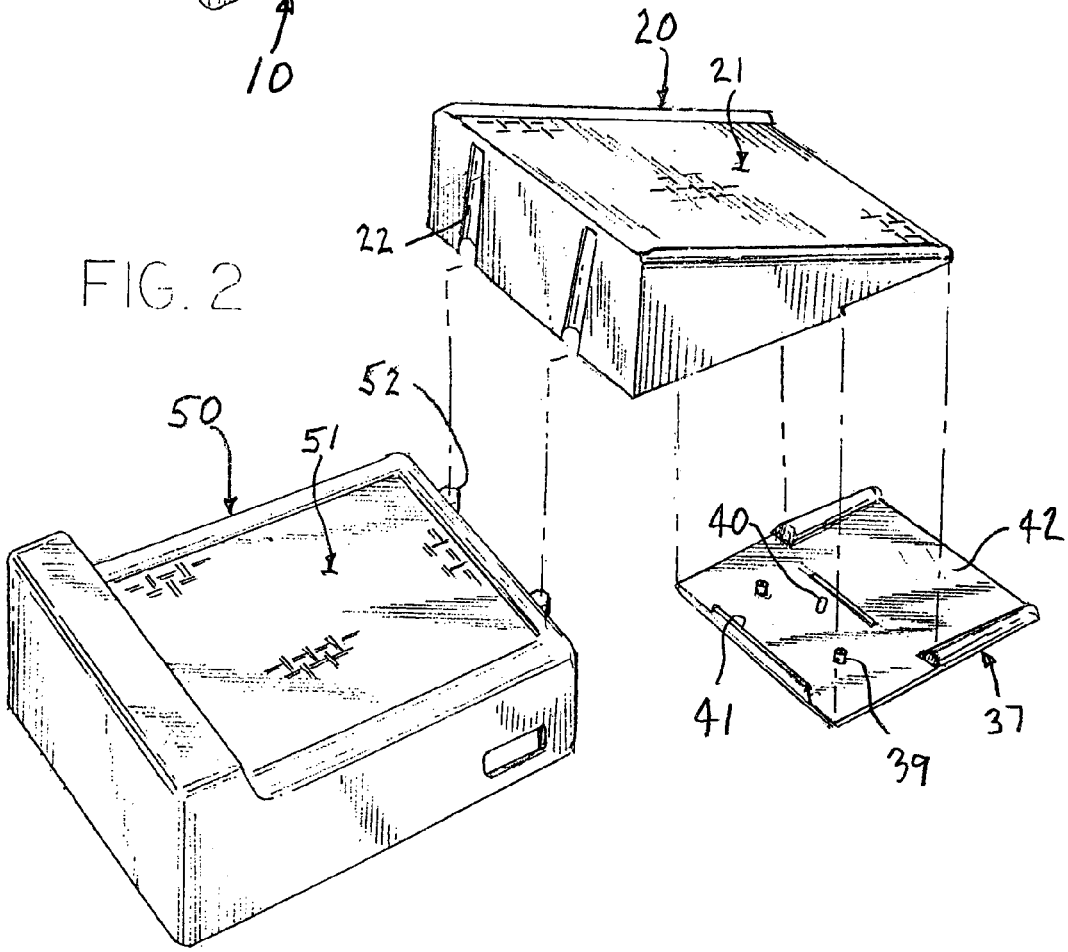
FIG. 2 is a somewhat exploded perspective view of the car ramp, shown with its major components disassembled.
Figure 3:
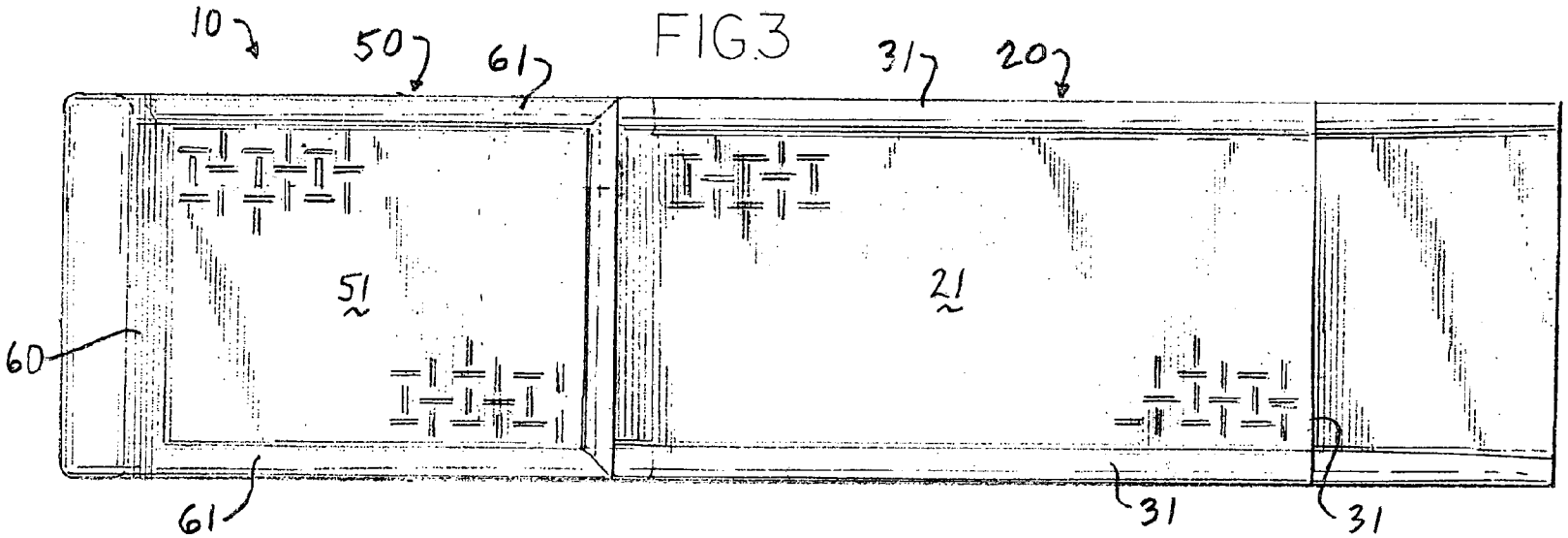
FIG. 3 is a top view of the assembled car ramp.

The illustrated portable car ramp 10 is made is made up of two major structural components 20, 50, respectively having thereon an inclined wheel run 21 and an elevated wheel run 51. The components 20, 50 have cooperating telescoping socket and pin formations 22, 52 adapted to separably couple the components 20, 50 together longitudinally of the wheel runs 21, 51, while allowing limited freedom of movement otherwise.

Figure 7:
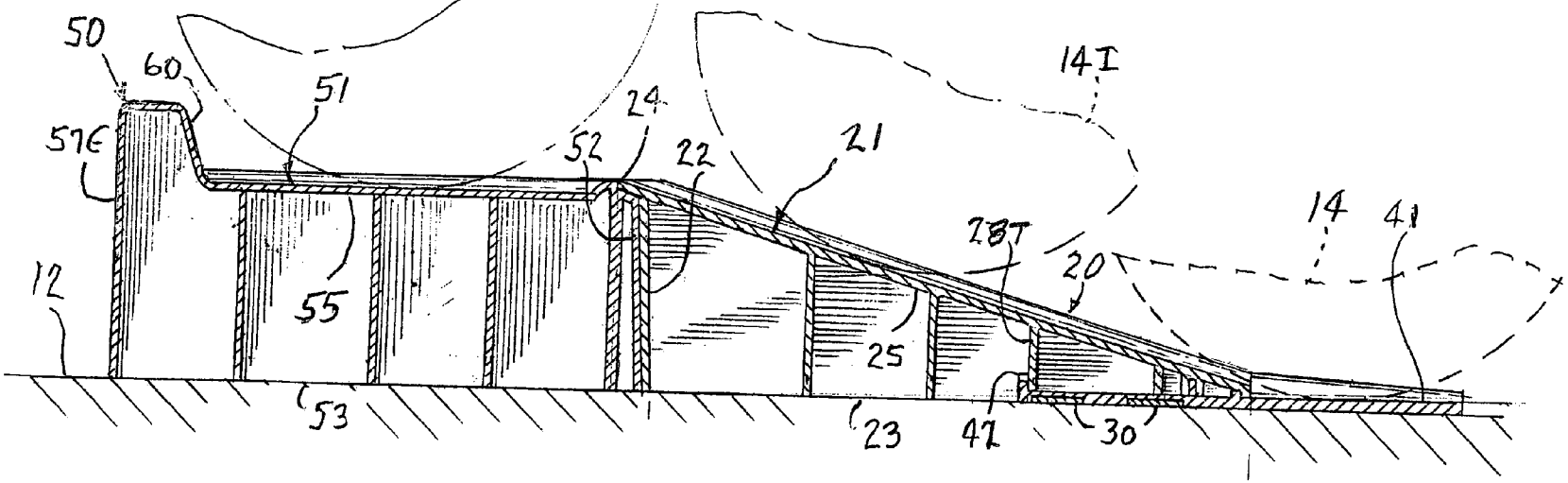
FIG. 7 is a sectional view of the assembled car ramp, as seen generally from line 7—7 in FIG. 4, showing in phantom a vehicle wheel in three different possible operative positions.

When the components 20, 50 are coupled, bottom edges 23, 53 (see FIG. 7) on the respective components laterally lie generally along a single plane suited to be stable when positioned on a generally flat surface 12, such as a garage floor, driveway, or like support medium. The inclined and elevated wheel runs 21, 51 are then longitudinally aligned, meeting along corner edge 24; while inclined wheel run 21 terminates at its lower end just above the support medium 12.

The elevated wheel run 51 and the bottom edge 53 of component 50 should be extended along substantially parallel planes; and their separation defines the approximate vertical lift above the support medium 12 of a vehicle wheel 14*e* (see FIG. 7) when carried on the elevated run.

These structural ramp components 20, 50 are preferably injection molded from a durable thermal plastic, such as polypropylene, such as to have unitary respective top walls 25, 55, and the side walls 26, 56 and end walls 27, 57, 57E depending downwardly therefrom. Further, internal reinforcing walls or webs 28L, 28T, 58L, 58T are integrally extended between these walls and themselves, much in the manner of a honeycomb configuration. The side and end walls and the honeycomb webs are disposed substantially normal (except for possible molding drafts) to, and are open at, the bottom edges 23, 53. This provides that the components 20, 50 have great vertical load carrying strength while yet are lightweight.

Figure 4:
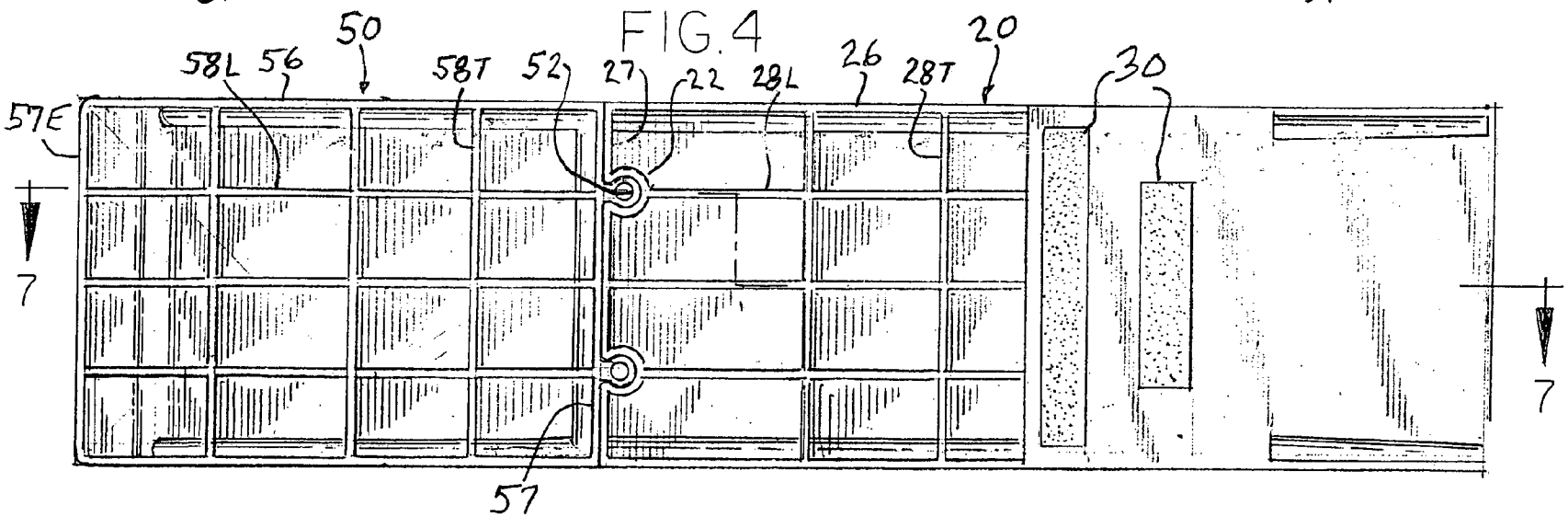
FIG. 4 is a bottom view of the assembled car ramp.
Figure 6:
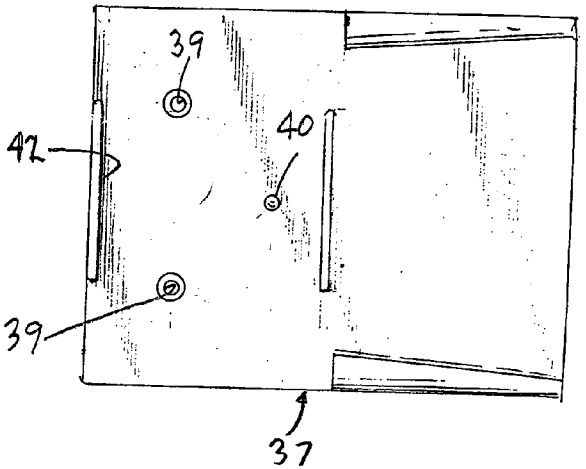
FIG. 6 is a top view of the friction mat component, shown disassembled from other car ramp components.
Figure 5:
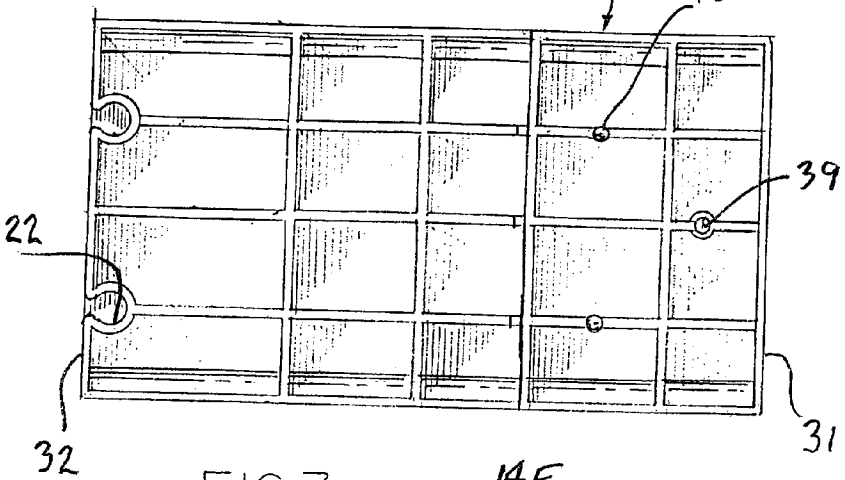
FIG. 5 is a bottom view of the inclined wheel run component, shown disassembled from other car ramp components.

Friction pads 30 (FIG. 4) can be secured to the underside of the inclined run component 20, between its front and rear edges 31, 32. The pads 30 can be formed of a compressible durable material, such as rubber, and be sized to project beyond the bottom edge 23. Thus, the pads 30 will be pressed firmly against the support medium 12 when a vehicle wheel (as at 14 or 14I) is on the inclined wheel run 21. This adds drag between the component 20 and support medium 12, effective to reduce ramp sliding along the support medium 12 so as to offset vector forces of the wheel rolling on the inclined run.

A wheel stop 64 can be formed at the rear end of the elevated run 51, such as by curving top wall 55 upwardly, rearwardly, and then downwardly to blend with rear end wall 57E. Further, raised guide edges 35, 65 can be formed laterally adjacent both wheel runs 21, 51, by extending the component side walls 26, 56 in the same manner slightly above the wheel runs and then blending with the top walls 25, 55.

Note that as the vehicle wheel rolling along the wheel runs 21, 51 passes over the corner 33, the wheel weight transfers from being totally on the inclined run component 20 to being totally on the elevated run component 50, or vice versa. The elevated wheel run component 50 has no friction pads 30 or the like on its supporting bottom edge 53, and being of hard plastic, it can slide more easily along the support medium 12 compared to the component 20.

With these differentials of the wheel weight carried on and the drag of the inclined and elevated run components, the car ramp 10 beneficially is more apt to remain stationary when the wheel rides up the inclined run 21 to counteract the tendency to slide because of vector forces against the ramp, and is more apt to have the car ramp slide when a rolling wheel 14E on the elevated run 51 hits against the stop 60. Thus, the car ramp 10 is easier to ride up onto and is less likely to allow wheel overriding the stop and falling off the elevated run 51.

A mat 37 further can be secured relative to the inclined run component 20 under the lower front portion thereof, as against a notched portion of the internal reinforcing side walls 26 and webs 28L, 28T. Snugly cooperating openings 39 and posts 40 on the component 20 and mat 37 can be used to fasten the mat 37 soundly to the component 20. A upturned tab 42 on the mat 37 further can be positioned against a rear face of the internal webs 28T to strengthen the connection of the mat longitudinally of the component 20.

The mat 37 might extend possibly one-half foot or so longitudinally away from of inclined run 22, to define a positioning wheel run 41 lying directly on the support medium 12 that is longitudinally aligned with the adjacent inclined wheel run 21. The mat 37 can be formed of a compressible durable high friction material, such as rubber, and be sized to be compressed slightly when the component is against the support medium. The friction pads 30 and mat 37 can be formed from the same piece.

With the positioning and inclined runs 41, 21 being fixed relative to one another longitudinally, with the vehicle wheel 14 on the positioning run 41 the mat 37 is biased against the medium support whereupon even typical frictional drag between the ramp and medium support will hold the ramp firmly in place until the wheel 14 reaches the inclined run 21. As the vehicle wheel initially rides up the inclined run 41, the increased drag of the friction pads 30 should continue to hold the ramp in place without any ramp sliding, as noted above.

The cooperating telescoping socket and pin formations 22, 52 can be formed in conical shapes, on longitudinal axes generally perpendicular to the bottom edge 23 of the component 20, with the largest cross-sections located adjacent the bottom edge 23. The cooperating formations are sized and shaped to complement one another for achieving strong longitudinal coupling connection together but without axial binding, for allowing easy coupling or decoupling of the components. This connection further will allow vertical shifting between the structural components when such are properly supported on a solid medium surface, thereby providing that substantially all vertical wheel forces will be transferred from one component to the other as the wheel rolls across the corner edge 24. The coupling connection lastly will preclude decoupling of component 20 from the component 50 when a vehicle wheel 14E is supported on the component 50.

The separate structural component 20, 50 can thus be coupled or interlocked together for easy ramp set up, but otherwise can be decoupled or separated for easy separate component movement about or for ramp storage.

While a single embodiment has been disclosed, others could be possible and even be more popular. However, the invention is to be defined not only by the disclosure but by the scope of the following claims.

What is claimed as my invention is:

1. A portable car ramp, comprising the combination of first and second separate structural components each having thereon respective generally planar bottom edges suited to be supported on a substantially flat medium surface, and said first component having an elevated wheel run extended generally parallel to but elevated above said bottom edge thereof, and said second component having an inclined wheel run generally elevated above said bottom edge thereof but extended between opposite lower and higher ends respectively that are even generally with its bottom edge and with the first component elevated wheel run;

cooperating pin and groove formations angled generally normal to the bottom edges of the respective components operable with limited clearances therebetween to telescope and to interlock the components together against movement in the direction of the elevated wheel run, while allowing relative component shifting in the direction normal to the bottom edges, whereby with the elevated end of the inclined wheel run component disposed adjacent the elevated wheel run component, a vehicle wheel can roll up or down the inclined wheel run and onto or off the elevated wheel run, and wheel weight is carried only on the structural component that the wheel is on; and a unitary friction pad having a first portion secured to the inclined wheel run component proximate the bottom edge thereof intended to lie against the medium surface, and a second portion extended several inches away from and aligned with the inclined wheel run and suited also to lie against the medium surface, whereby wheel weight on the second portion of the friction pad and on inclined wheel run component compresses said friction pad against the medium surface to resist ramp sliding along the medium surface, while wheel weight on the elevated wheel run component provides no compression of the friction pad which then is ineffective in resisting ramp sliding along the medium surface.

2. A portable car ramp according to claim 1, further wherein said cooperating formations are conical socket and pin formations on the respective components disposed along longitudinal axes extending generally perpendicular to the bottom edges, said conical socket and pin formations being oriented so that component assembly can occur by relative component movement advancing the inclined wheel run component upwardly from the underside of the elevated wheel run component whereupon binding between the formations first occurs when said inclined wheel run component bottom edge is elevated slightly past or above the elevated wheel run component bottom edge, thereby allowing easy component assembly and disassembly while precluding attempted component disassembly when in use with the wheel weight yet on the elevated wheel run component.

3. A portable car ramp according to claim 2, further having a stop upstanding from the elevated wheel run at the end thereof opposite from the inclined wheel run component, effective for limiting wheel rotation on the elevated wheel run in the direction away from the inclined wheel run component.

* * * * *